United States Patent [19]

Marino

[11] 4,360,992

[45] Nov. 30, 1982

[54] DIMENSIONALLY STABLE WOOD FLOORING

[76] Inventor: Vincent J. Marino, 45 West St., Beverly Farms, Mass. 01915

[21] Appl. No.: 231,862

[22] Filed: Feb. 5, 1981

Related U.S. Application Data

[63] Continuation of Ser. No. 963,094, Nov. 22, 1978, abandoned.

[51] Int. Cl.[3] ..... E04C 1/06

[52] U.S. Cl. ..... 52/309.4; 52/573; 52/403; 52/741

[58] Field of Search ..... 52/573, 390, 309.7, 52/309.8, 309.4, 403, 309.5, 396, 741; 404/47, 64

[56] References Cited

U.S. PATENT DOCUMENTS

| | | | |
|---|---|---|---|
| 1,756,583 | 4/1930 | Cadwallader . | |
| 1,890,954 | 12/1932 | Snyder . | |
| 1,913,290 | 6/1933 | Rockwell . | |
| 2,026,511 | 12/1935 | Storm . | |
| 2,277,892 | 3/1942 | Swenson . | |
| 3,334,557 | 8/1967 | Fitzgibbon | 52/309.5 X |
| 3,365,850 | 1/1968 | Marino | 52/309.3 |
| 3,579,941 | 5/1971 | Tibbals . | |
| 3,629,986 | 12/1971 | Klittich | 52/396 |
| 4,050,206 | 9/1977 | Utsuyama | 404/64 |

*Primary Examiner*—Carl D. Friedman

*Attorney, Agent, or Firm*—Kenway & Jenney

[57] ABSTRACT

A dimensionally stable wood flooring highly resistant to deterioration because of variations in environmental humidity and temperature employs individual wood fillets separated by a highly compressible synthetic foam spacer. Because the foam spacer accommodates large fillet dimensional changes, the fillets may be wider than previously used or made of less inherently dimensionally stable woods.

10 Claims, 2 Drawing Figures

FIG. 1
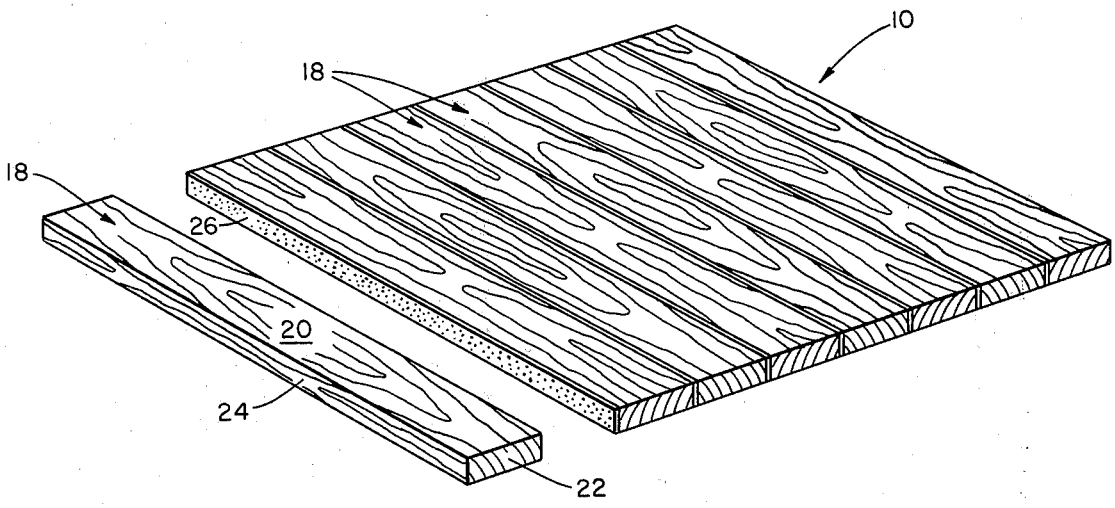
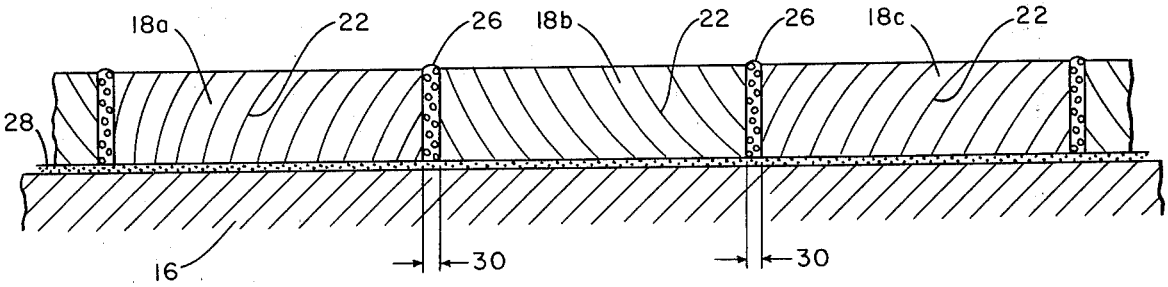
FIG. 2

DIMENSIONALLY STABLE WOOD FLOORING

This is a continuation of application Ser. No. 963,094, filed Nov. 22, 1978, bandoned.

BACKGROUND OF THE INVENTION

This invention relates to wood flooring and more particularly to an improved, dimensionally stable wood flooring which is highly resistant to deterioration because of variations in humidity and temperature.

It is well known that wood flooring fillets expand and contract significantly when exposed to changes in temperature and humidity. This dimensional instability has been a serious problem in wood floors, especially those in which the wood strips or fillets are not secured to one another by means of a backing material, but rather are adhered directly to a subfloor. Such a floor is subject to buckling if inadequate space is provided between the fillets so that upon expansion they press unduly against one another. To prevent buckling, some prior floors employed relatively large gaps between adjacent fillets. Not only are large gaps unsightly, but they can become filled with dirt and grit, effectively diminishing the available expansion space. In other floors, especially those covering large areas, adjacent tiles made up of a plurality of fillets have been laid with their grains running in alternate directions. Because woods expand and contract by differing amounts in different directions with respect to grain orientation, such a parquet arrangement limits dimensional changes across the gaps separating contiguous tiles, thereby reducing the likelihood of buckling.

One approach to solving the dimensional instability problem has been to fill the gaps with a flexible bonding material which has sufficient compressibility to accommodate the maximum change in gap width. See, for example, U.S. Pat. No. 3,365,850 in which the preferred bonding material is a blend of chloroprene synthetic rubber, esterified rosin and an antioxidant. Although this material remains flexible, it is of limited compressibility so that only a relatively small portion of the gap thickness is available for fillet expansion.

The limited compressibility and expandability of the previously used gap filling materials have several disadvantages. First, since much of the gap width cannot be utilized, the maximum amount of expansion of a fillet for a given gap width must be limited. One means of bounding expansion has been to limit the maximum width of the fillet to approximately one inch. Another means has been to orient the fillet with respect to the wood grain so that the surface adjacent to the gap is the flat grain face. It is known that dimensional changes transverse to the flat grain faces are less than for other grain orientations. A third way to control the amount of dimensional change is to use woods with inherent dimensional stability. Woods such as beech and gumwood have accordingly been avoided in the past because they are less dimensionally stable than other woods, such as oak and maple. Again, because of the limited elasticity of the previously used binding material in the gap, high shear stresses develop between fillets during expansion, requiring very rigid adhesive to prevent the fillet from breaking away from the subfloor. Each of these constraints imposed by the prior gap-filling materials adds considerably to the cost of the finished floor.

It is, therefore, an object of the present invention to provide dimensionally stable wood flooring having a highly compressible gap-filling material between the wood fillets, that is, a material which can be compressed to a small fraction of its unstressed thickness.

It is a further object of the invention to provide a gap filler that allows the use of wider fillets or planks made up of multiple fillets, and eliminates the need to alternate the grain direction of adjacent planks, especially advantageous in floors covering large open areas.

Yet a further object is a gap filler for wood flooring for which the fillet surface adjacent to a gap is a mixed or flat grain.

Still another object is a gap filler which permits wood flooring to be secured to a subfloor with a lower cost, less rigid and more tacky adhesive than before possible.

A still further object of the invention is a gap-filling material which allows the flooring to accommodate an irregular subfloor.

Other objects, features and advantages of the present invention will become apparent in what follows.

SUMMARY OF THE INVENTION

Dimensionally stable wood flooring according to the present invention employs selected foam materials as the spacer between wood fillets to allow for fillet expansion. The expansion gaps between the individual fillets are filled with a highly compressible, synthetic foam material having substantially permanent flexibility and compressibility sufficient to accommodate changes in gap width due to expansion and contraction of the wood fillets. Each fillet is secured to a subfloor by means of an adhesive which holds the fillet substantially stationary as it undergoes cycles of expansion and contraction.

In a preferred embodiment of the invention, the foam material which fills the gaps between fillets is a blend of chloroprene synthetic rubber, rosin esterified with pentaerythritol, an anti-oxidant and a foaming agent, bicarbonate of soda being the preferred foaming agent. The preferred adhesive for securing the fillets to the subfloor is a standard, rubber-based wood block adhesive.

In another important embodiment of the invention, the gap-filling foam material is a preformed sheet adapted to fit into and fill the gaps. Preferred preformed sheets are neoprene and polyethylene foam and are adhered to the wood fillet.

BRIEF DESCRIPTION OF THE DRAWINGS

The invention disclosed herein may be better understood with reference to the following drawings of which:

FIG. 1 is a partly exploded view of a preassembled wood flooring tile embodying the invention; and FIG. 2 is an end elevation view of the installed flooring under the condition of extreme expansion.

DESCRIPTION OF THE PREFERRED EMBODIMENTS

Referring now to FIG. 1, a representative flooring tile 10 has been partly exploded to show better an individual wood fillet 18. In this figure, the wood grain runs along the length of the fillet 18 and the fillet is cut so that the edge grain surface is the wearing surface 20, that is, the lines 22 that demarcate the growth rings on the tree from which the fillets 18 are cut extend substantially between the upper and lower surfaces of each fillet. Hence, the lateral surfaces 24 of each fillet are the flat grain surfaces. It is to be stressed that wood fillet 18 need not have been cut so that the lateral surfaces 24 on each fillet are the flat grain surfaces. Although it is advantageous to orient the fillets in this way because dimensional stability transverse to the grain lines 22 is about twice the dimensional stability along the grain lines, it is unnecessary to do so because the foam material filling the gap according to this invention can accommodate larger expansions of the fillets.

Again because the foam gap-filling material can accommodate greater fillet expansion, individual fillets made from dimensionally stable wood species can be up to two inches in width with a gap width between fillets no greater than that in floors having narrower fillets, e.g., gap widths in the range of 1/64 to 1/16 inch. When, however, wider fillets are fashioned from less dimensionally stable wood species, gaps between adjacent fillets will be larger, up to approximately ⅛ inch, to accommodate the expected greater dimensional changes.

Referring now to FIG. 2, gaps 30 between fillets 18 are filled with foam layer 26. Foam layer 26 may be formed in place or it may be made of a preformed foam sheet bonded to the adjacent fillets. A suitable material for forming foam layer 26 in place is a blend of chloroprene synthetic rubber, esterified rosin, and an anti-oxidant as disclosed in U.S. Pat. No. 3,365,850, with a foaming agent such as bicarbonate of soda added. This blend produces a highly compressible, closed cell foam. Foam layer 26 may also be cut from a preformed sheet of neoprene or polyethylene. A suitable neoprene is number 4,002 manufactured by Tenneco Chemicals, Inc., General Foam Division, Carlstadt, NJ, and a suitable polyethylene sheet is Volara Type E manufactured by Voltek, Inc. of Lawrence, MA. When preformed sheet is used as foam layer 26, a suitable adhesive is used to bond the preformed sheet of foam to the adjacent wood fillets. Use of preformed foam materials simplifies both the manufacturing process and also the machinery required to assemble the fillets within a single flooring tile. Such use of preformed foam also substantially increases the hourly output capacity of an assembly system, thereby reducing production costs.

The fillets 18 are preassembled to form tiles with a gap of 1/64 inch to ⅛ inch between contiguous fillets. This gap width is generally sufficient to accommodate the maximum dimensional change in fillet width. With a gap width within this range, it has been found that the foam layer 26 continuously spans and substantially fills the gaps under all conditions of fillet expansion and contraction. This is particularly important in excluding dirt from the gaps under extreme contraction.

As shown in FIG. 2, the tile is secured to the subfloor 16 with an adhesive 28 that holds the fillets in place against the forces that develop during the dimensional changes due to temperature and humidity. Because foam layer 26 disposed between adjacent fillets 18 is highly compressible, the forces which develop between the individual fillets are not high. This permits the use of a less rigid and less costly adhesive 28 such as standard rubber-based wood block adhesive to secure the tiles to the subfloor. The use of a less rigid adhesive imparts a greater degree of flexibility to the tiles thereby permitting them to conform more readily to irregularities in the subfloor 16.

Referring still to FIG. 2, the illustrated fillets 18*a*, 18*b*, and 18*c* are shown under the condition of maximum expansion as caused by high environmental temperature and humidity, for example. Note, however, that the gaps 30 still remain between adjacent fillets and the continuous foam layers 26 separate the fillets.

The dimensionally stable wood flooring disclosed herein, therefore, comprises wood fillets separated by a synthetic foam layer which is highly compressible. Because the foam layer can accommodate large amounts of compression, the wood fillets can be wider than previously used or even be cut so that the surface adjacent the gaps is a mixed grain or a flat grain surface. Incorporating a foam layer also permits the use of less dimensionally stable woods formerly thought inappropriate for wood flooring, such as gum and beechwood. Another advantage to be realized from the invention herein is the capability to construct stable floors of multiple fillets joined to form wide wooden planks, illustratively of seven inches in width, laid substantially parallel and side-by-side, i.e., without the requirement to alternate grain directions. The invention disclosed herein, therefore, permits lower cost, yet dimensionally stable wood floors.

In view of the foregoing, it may be seen that the objects of the present invention have been achieved and other advantageous results obtained.

As various changes could be made in the above preferred embodiments without departing from the scope of the invention, it should be understood that all matter contained in the above description or shown in the accompanying drawings shall be interpreted as illustrative and not in a limiting sense.

What is claimed is:

1. Dimensionally stable wood flooring comprising wood fillets separated by gaps, each fillet having a width no greater than approximately two inches and each gap having a width less than one-eighth inch and larger than one-sixty fourth inch, wherein each of said fillets A. is elongated in the direction of the wood grain;

B. has a substantially rectangular cross-section;

C. is arranged for being secured to a subfloor with an adhesive; and

D. further characterized in that a compressible synthetic foam material fills said gaps and joins said fillets together, said foam material having flexibility, compressibility and expandability sufficient to span continuously said gaps under substantially all environmental conditions of expansion and contraction of said fillets when secured to a subfloor, and wherein said foam material is a preformed sheet adapted to fit into and fill said gaps between said fillets.

2. The flooring according to claim 1 wherein said preformed sheet is neoprene foam.

3. The flooring according to claim 1 wherein said preformed sheet is polyethylene foam.

4. Dimensionally stable wood flooring comprising wood fillets separated by gaps, wherein each of said fillets (A) is elongated in the direction of the wood grain;

(B) has a substantially rectangular cross-section;

(C) is arranged for being secured to a subfloor with an adhesive; and (D) further characterized in that a compressible synthetic foam material comprising a blend of chloroprene synthetic rubber, esterified rosin, an anti-oxidant and a foaming agent fills said gaps and joins said fillets together, said foam material having flexibility and compressibility sufficient to accommodate changes in the widths of each of said gaps due to changes in the widths of said fillets contiguous therewith, and wherein said foam material is a preformed sheet adapted to fit into and fill said gaps between said fillets.

5. The flooring of claim 4 wherein said rosin is esterified with pentaerythritol and said foaming agent is bicarbonate of soda.

6. The flooring of claim 4 wherein said foaming agent is bicarbonate of soda.

7. In the manufacture of dimensionally stable wood flooring for securing to a subfloor and comprising wood fillets separated by gaps, each fillet being elongated in the direction of the wood grain and having a substantially rectangular cross-section, the improvement comprising the steps of A. selecting a compressible synthetic foam material in sheet form characterized by flexibility, compressibility and expandability sufficient to span continuously said gaps under substantially all conditions of environmental expansion and contraction of said fillets upon being secured to a subfloor, B. introducing said sheet material into said inter-fillet gaps, and C. adhering said sheet material to said fillets to join said fillets into wood flooring sheets.

8. A method according to claim 7 comprising the further step of adhering said wood flooring sheets to a sub-floor.

9. A method according to claim 7 wherein said selecting step provides a sheet material comprising a blend of chlorophrene synthetic rubber, esterified rosin, an antioxidant, and a foaming agent.

10. In the manufacture of dimensionally stable wood flooring adapted to be secured to a subfloor and comprising wood fillets separated by gaps, each fillet having a width no greater than approximately two inches and each gap having a width less than one-eighth inch and larger than one-sixty-fourth inch, and wherein each said fillet is elongated in the direction of the wood grain and has a substantially rectangular cross-section, the improvement comprising the steps of A. selecting a compressible synthetic foam material in sheet form characterized by flexibility, compressibility and expandability sufficient to span continuously said gaps under substantially all conditions of environmental expansion and contraction of said fillets upon being secured to a subfloor, B. introducing said sheet material between said fillets, and c. securing said sheet material to said fillets to join said fillets into wood flooring sheets.

* * * * *